US008556099B2

(12) United States Patent
Perlman

(10) Patent No.: US 8,556,099 B2
(45) Date of Patent: Oct. 15, 2013

(54) COLLAPSIBLE CUP FOR ZERO WASTE APPLICATIONS

(76) Inventor: Diane Perlman, Washington, DC (US)

( * ) Notice: Subject to any disclaimer, the term of this patent is extended or adjusted under 35 U.S.C. 154(b) by 45 days.

(21) Appl. No.: 13/158,056

(22) Filed: Jun. 10, 2011

(65) Prior Publication Data

US 2011/0303659 A1 Dec. 15, 2011

Related U.S. Application Data

(60) Provisional application No. 61/397,536, filed on Jun. 11, 2010.

(51) Int. Cl.
*B65D 6/16* (2006.01)

(52) U.S. Cl.
USPC ..... 220/8; 220/666; 220/735; 206/37; 206/217; 206/218; D7/512; 47/66.1

(58) Field of Classification Search
USPC ..... 220/8, 666, 735; 206/37, 217, 218; D7/512; 47/66.1
See application file for complete search history.

(56) References Cited

U.S. PATENT DOCUMENTS

| | | | |
|---|---|---|---|
| 577,764 | A | 2/1897 | Lines |
| 640,418 | A | 1/1900 | Royer |
| 693,959 | A | 2/1902 | Finley |
| 879,753 | A | 2/1908 | Eckert |
| 921,514 | A | 5/1909 | Dacus |
| 988,453 | A | 4/1911 | Forney |
| 1,010,581 | A | 12/1911 | Burns |
| 1,020,347 | A | 3/1912 | Follett |
| 1,025,380 | A | 5/1912 | Curtis |
| 1,033,744 | A | 7/1912 | Smith |
| 1,048,935 | A | 12/1912 | Brady |
| 1,049,199 | A | 12/1912 | Bowman |
| 1,093,873 | A | 4/1914 | Mitchell |
| 1,117,109 | A | 11/1914 | Tichborne |
| 1,120,229 | A | 12/1914 | Nieman |
| 1,154,185 | A | 9/1915 | Hollis |
| 1,154,627 | A | 9/1915 | Hall |
| 1,188,443 | A | 6/1916 | Gutman |
| 1,255,133 | A | 2/1918 | Carr |
| 1,264,040 | A | 4/1918 | Fackler |
| 1,482,425 | A | 5/1922 | Ziony |
| 1,478,838 | A | 12/1923 | Reifsnyder |
| 1,498,672 | A | 6/1924 | Renner |
| 1,561,509 | A | 11/1925 | Davidson |
| 1,636,323 | A | 7/1927 | Rand |
| 1,690,586 | A | 11/1928 | Main |
| 1,692,951 | A | 11/1928 | Pickney |
| 1,738,779 | A | 12/1929 | Lockwood |

(Continued)

FOREIGN PATENT DOCUMENTS

| | | | |
|---|---|---|---|
| DE | 19540528 | A1 | 5/1996 |
| EP | 1591369 | A1 | 2/2005 |

(Continued)

*Primary Examiner* — Anthony Stashick
*Assistant Examiner* — Elizabeth Volz
(74) *Attorney, Agent, or Firm* — Gearhart Law, LLC

(57) ABSTRACT

The present invention is a collapsible vessel and also a method of reducing waste. The collapsible vessel has a mechanism that maintains its rigidity in its expanded form, yet allows it to be collapsed when desired. The vessel also has a removable lid, and the vessel, lid, or both may carry logos or other images or indicia, particularly those of restaurant or beverage chains.

12 Claims, 18 Drawing Sheets

(56) References Cited

U.S. PATENT DOCUMENTS

| | | | | |
|---|---|---|---|---|
| 1,816,547 | A | 7/1931 | Ringler | |
| 2,236,060 | A | 3/1941 | Hyndman | |
| 2,438,434 | A | 3/1948 | Friedman | |
| 3,285,459 | A | 11/1966 | Gahm | |
| D309,116 | S | 7/1990 | Marshall | |
| 4,940,138 | A | 7/1990 | Hornstein | |
| D322,012 | S | 12/1991 | Mercier | |
| 5,101,996 | A | 4/1992 | Mosley | |
| 5,439,128 | A | 8/1995 | Fishman | |
| 5,501,363 | A * | 3/1996 | Muller et al. | 220/630 |
| 6,666,329 | B1 | 12/2003 | Charbonneau | |
| 6,736,285 | B2 | 5/2004 | Stewart-Stand | |
| D544,303 | S | 6/2007 | Strepkoff | |
| 2003/0160055 | A1 | 8/2003 | Stewart-Stand | |
| 2004/0154954 | A1 | 8/2004 | Joan | |
| 2007/0029213 | A1 | 2/2007 | Hall | |
| 2009/0308867 | A1 * | 12/2009 | Lal | 220/8 |

FOREIGN PATENT DOCUMENTS

| | | | |
|---|---|---|---|
| EP | 1616801 | B1 | 7/2008 |
| GB | 190515528 | A | 9/1905 |
| GB | 146955 | A | 3/1921 |
| GB | 1125488 | A | 8/1968 |
| GB | 2269151 | A | 2/1994 |
| WO | WO9812116 | A1 | 3/1998 |
| WO | WO9836978 | A2 | 8/1998 |
| WO | WO 98/51186 | A1 | 11/1998 |

* cited by examiner

COLLAPSIBLE CUP FOR ZERO WASTE APPLICATIONS

PRIORITY CLAIM

This application claims priority of U.S. provisional application No. 61/397,536, which was filed on Jun. 11, 2010 and is incorporated herein by reference in its entirety.

FIELD OF THE INVENTION

The invention relates to collapsible cups useful for containing beverages.

BACKGROUND OF THE INVENTION

The idea of manufacturing cups which collapse and can be re-expanded is attractive because of the reduction in storage and transportation space for the cup. Many attempts have been made in the prior art to perfect such a cup; examples are cited below.

U.S. Pat. No. 988,453 teaches a collapsible drinking cup that is disposable, and is designed to be used once and then thrown away.

U.S. Pat. No. 1,010,581 teaches a collapsible drinking cup that has telescoping sections, a folding handle, a base plate, and a box or container for the cup.

U.S. Pat. No. 1,025,380 teaches a collapsible drinking cup made from water proof material such as sheet rubber, and has a support for the cup in its extended position.

U.S. Pat. No. 1,033,744 teaches a collapsible cup with flexible walls so that it can be twisted and folded.

U.S. Pat. No. 1,049,199 teaches a collapsible drinking cup with a handle and a spring mechanism that engages to expand the cup when the handle is released.

U.S. Pat. No. 1,482,425 teaches a collapsible drinking cup composed of telescopic tapering sections which engage each other when turned such that the head on one section engages against the edge of the adjoining section and thereby the sections are locked together.

U.S. Pat. No. 7,736,285 teaches a collapsible container such as a drinking cup that has a disk-shaped bottom and a disk-shaped cover which fit one within the other and engage by catches. A molded inner cup body has its base connected to the bottom and a mouth surrounded with a ring which seals to the cover and springs up from the bottom to erect the cup when the catches are released.

US Application 20030160055 teaches a collapsible container such as a drinking cup that has a disk-shaped bottom and a disk-shaped cover which fit one within the other and engage by catches. A molded inner cup body has its base connected to the bottom and a mouth surrounded with a ring which seals to the cover and springs up from the bottom to erect the cup when the catches are released.

US Application 20070029213 teaches an article dispenser having a detachable base, one or more detachable trays, and a detachable cup. The base, tray, and cup have corresponding cylindrical sidewalls to permit vertical stacking, attachment, and rotation. The tray consists generally of a hollow cavity for storing articles such as pills or vitamins and an outlet appendage through which the articles may be dispensed. Stacking a tray atop the base and then turning the tray with a clockwise, rotating motion guides the tray to a centered position and secures it to the base. The base, one or more trays, and the cup may be stacked in this manner to assemble the device. Rotating a stacked and secured tray further clockwise, beyond its centered position, reveals the tray outlet appendage and enables the user to dispense a loaded item. Conversely, rotating a stacked and secured tray counter-clockwise, beyond its centered position, releases the tray and enables it to be removed from the stack and filled. The cup is configured to contain and dispense liquid for drinking, thus aiding in the act of consumption.

International Patent WO1998051186 teaches a collapsible drinking cup comprising several telescopically movable concentric engaging ring elements, which cup is provided with a cylindrical cover and a bottom support, where the innermost concentric ring element is fastened to the bottom support. The cover comprises at least a plane part provided with a closing member of the same material, and the bottom support is provided with at least one concentric flange.

The present invention is an improvement over the prior art in a number of ways. The present invention is not only a collapsible cup, but also is, in one embodiment, a method of reducing waste. The present invention can be substituted for disposable cups made of plastic, paper or cardboard, therefore relieving the burden on landfills. The collapsible cup of the present invention can be made out of durable materials that can be used over and over again, materials that may not have even existed when some of the prior art was published. The cup's collapsible nature allows it to be conveniently transported in a user's pocket or purse. The present design of the collapsible cup is unique, because it has a removable lid and an era bottom. These features allow the cup to be placed in a cup holder in a vehicle.

Several embodiments of this invention are illustrated in the accompanying drawings and will be described in more detail herein below.

SUMMARY OF THE INVENTION

The present invention is a vessel. The vessel has a bottom ring having a bottom wall, the bottom wall having upper and lower bottom edges, inside and outside bottom surfaces, upper and lower bottom edge diameters, and a bottom disposed on the bottom wall. The invention also has at least one groove extending from the upper bottom edge to the lower bottom edge, the groove having a pin block, at least one locking dent in proximity to the upper bottom edge. The vessel has a top ring having a top wall, the top wall having upper and lower top edges, inside and outside top surfaces, upper and lower top edge diameters, and at least one groove extending from the upper top edge to the lower top edge. The groove has a pin block, at least one locking dent in proximity to the upper top edge, and at least one pin located on the top inside surface proximate to the top bottom edge.

Since the cup can be extended and locked into the open position by twisting, it is also foreseeable that advertising pictures or puzzles may be disposed on the inner or outer surfaces of the rings to form a picture when the cop is in a fully open position. The cup may also have markings on the internal surface to indicate the volume of the beverage or other substance placed in the cup.

The cup is ideally suited to be used as a promotional or advertising tool for large restaurant or coffeehouse chains that wish to promote their concern for the environment, specifically, by reducing waste and the consumption of forest products.

The design of the present invention can also be expanded to include other types of vessels as well such as bowls or vases, and also could be used for animal dishes, which would be particularly useful when traveling with an animal or taking a dog to a park or other area for exercise. The vessel could also be used to contain or house utensils or other items.

It is an object of the invention to be reusable.

It is an object of the invention to aid the environment by reducing waste.

It is an object of the invention to be easily portable.

It is an object of the invention to be easily stored.

It is an object of the invention to be an advertising medium.

It is an object of the invention to have a volume indication on the outside surface.

It is an object of the invention to have a volume indication on the inside surface.

It is an object of the invention to be used by a commercial organization.

It is an object of the invention to be used by a beverage or restaurant chain.

It is an object of the invention to be a method of reducing waste by creating an incentive by an organization to use a collapsible cup instead of disposable cups.

It is an object of the invention for the vessel to be made of materials that aren't easily breakable.

BRIEF DESCRIPTION OF THE DRAWINGS

A variety of the designs suitable for the cup and the present invention are attached as drawings. There are five embodiments illustrated in the drawings.

FIG. 1 is a perspective view of the invention in an extended configuration.

FIG. 2 is a perspective view of the invention in a collapsed configuration.

FIG. 3 is an exploded view of an invention component.

FIG. 4 is an exploded view of the invention.

FIG. 5 is perspective view of the invention in a collapsed configuration.

FIG. 6 is a side view of the invention in an extended configuration.

FIG. 8 is a front perspective view of the invention in an extended configuration.

FIG. 9 is a front perspective view of the invention in a collapsed configuration.

FIG. 10 is a side cut-away view of the invention in an extended configuration.

FIG. 11 is an inside cut-away view of the invention in an extended configuration.

FIG. 12 is an inside cut-away view of the invention in a collapsed configuration.

FIG. 13 is an exploded view of a component of the invention.

FIG. 14 is a front perspective view of the invention in an extended configuration.

FIG. 15 is a front view of the invention in an extended configuration.

FIG. 16 is a front perspective view of the invention in a collapsed configuration with a lid.

FIG. 17 is a front perspective view of the invention in a collapsed configuration with the lid removed.

FIG. 18 is a front view of the invention in a collapsed configuration.

DESCRIPTION OF THE PREFERRED EMBODIMENTS

Figure 1:
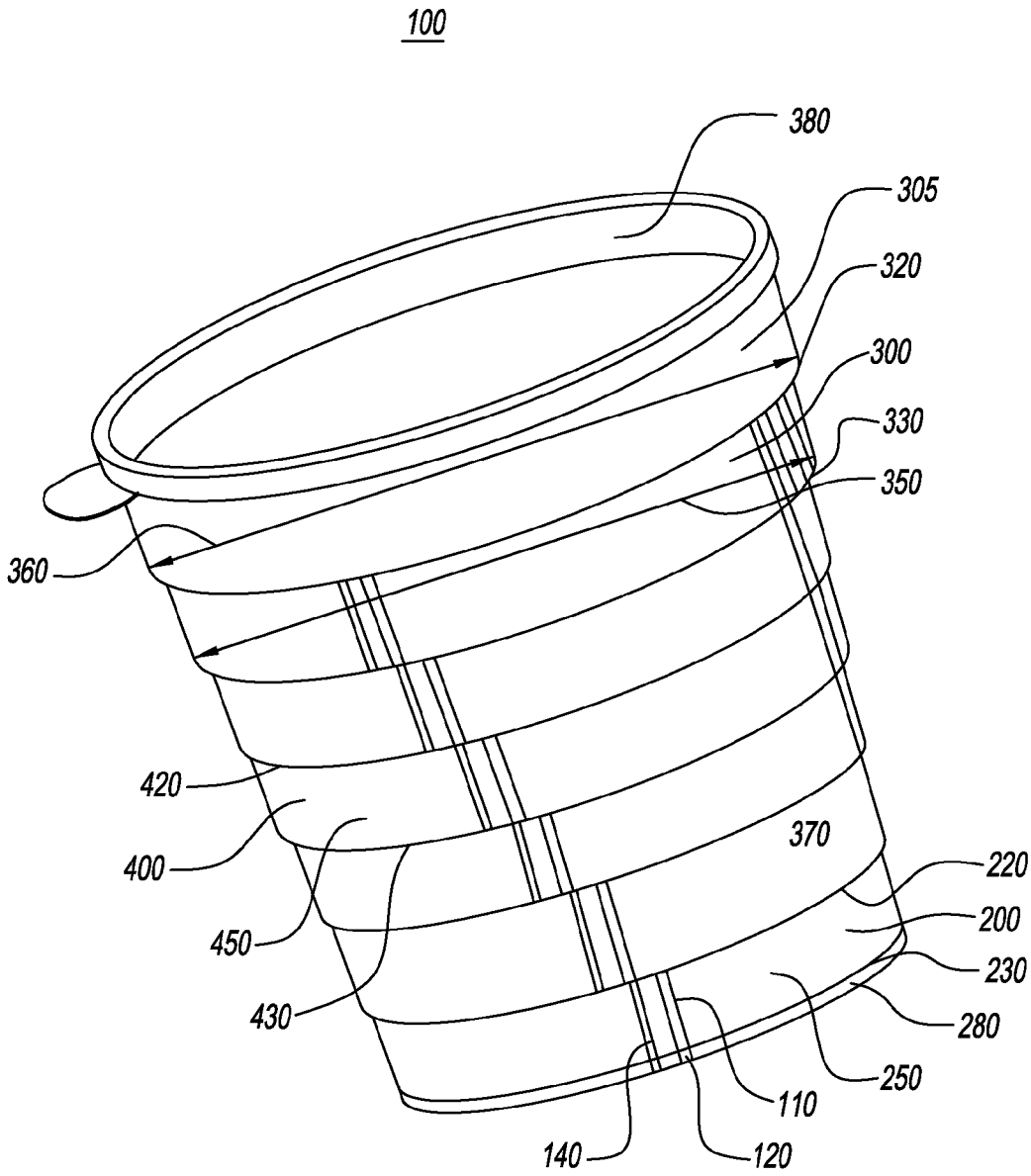
FIGS. 1-4 illustrate the first embodiment.

FIG. 1 shows a perspective view of a preferred embodiment of the present invention in its expanded state. FIG. 1 shows a vessel 100 with a groove 110, a pin block 120, and a locking dent 140. The locking dent 140 is a separate groove from the groove 110. These features allow the cup to be collapsed and expanded.

FIG. 1 also shows a bottom ring 200, bottom ring bottom wall upper bottom edge 220, bottom ring bottom wall lower bottom edge 230, bottom ring bottom wall outside bottom surface 250, and a bottom disposed on bottom wall 280.

Also shown in FIG. 1 is a top ring 300, with a top lip 305, top ring top wall upper top edge 320, top ring top wall lower top edge 330, top ring top wall outside top surface 350, a top ring top wall upper top edge diameter 360, and a top ring top wall lower top edge diameter 370. The top ring top wall upper top edge diameter 360 is larger than the top ring top wall lower top edge diameter 370; this allows the rings to nestle inside each other when the vessel 100 is collapsed.

There is also a removable lid 380. The removable lid 380 may be completely removable, or may be tethered to the vessel 100 so that it is partially removable. It may be tethered in any number of ways, including but not limited to, using a hinge, a rivet, a snap, a hook and loop fastener, or any means that allows the removable lid 380 to be tethered to the vessel 100, either in a permanent way or in a way such that it can be fastened on and later removed if desired. For instance, a hook and loop fastener or snap on the outside of the vessel 100 corresponding to a mate on the removable lid 380 may be employed to keep the removable lid 380 tethered to the vessel 100 when the removable lid 380 is removed from the top of the vessel to allow drinking or eating. A hinge or rivet would keep the removable lid 380 tethered to the vessel 100 in a more permanent manner.

As shown in FIG. 1, the vessel 100 has a middle ring 400, with a middle ring middle wall upper middle edge 420, a middle ring middle wall lower middle edge 430, and a middle ring middle wall outside middle surface 450. The figure shows four middle rings, but there can be any number of middle rings, from one to 100. The preferred number of middle rings is [4]

Although the preferred shape for the vessel 100 is round, it can be any shape, including but not limited to, square, rectangular, star shaped, pyramid shaped, shaped like a figure, such as but not limited to, a tree, a bird, a vehicle, or any figure desired.

As can be seen in FIG. 1, the rings of the vessel are different shades. The rings and removable lid may be any color or colors, may be the same for all rings and the removable lid, different for each ring and the removable lid, or any combination thereof, and may contain indicia, figures, patterns, or images on the inside, outside, or both, and on the entire vessel or removable lid, or any portion thereof.

The indicia may take a wide variety of forms, including but not limited to, advertisements, names (for instance, a company such as a restaurant chain, or a person's name), other personalized information, astrological signs, slogans, logos or trademarks, birthdates, or any other desired indicia.

The figures may include but are not limited to, advertisements, logos, media or other characters, animals, plants, drawings, inanimate objects, or any other desired figure.

The patterns may include but are not limited to, patterns, designs, color patterns, or any desired pattern.

The images may include but are not limited to, images of people, plants, animals, places, storefronts, media images, holographic images, digitally created or captured images, or any image desired. In addition, combinations of the media forms above may be employed. For instance, combinations of media include but are not limited to, comic strips, jokes, logos that contain both figures or images with indicia, characters with indicia, or any combinations desired. The indicia, figures, patterns, images or other media may be placed on the vessel such that they are completed and viewable when the vessel is extended, either on the outside or inside of the vessel or on both.

The vessel may contain a volume indication, either on the outside, inside, or both. The volume indication may include, but is not limited to, a color change or change to translucence caused by liquid inside the vessel, markings on the vessel, a window in the vessel, or the vessel may be entirely transparent so the volume is easily discernable.

The indicia, figures, patterns, images or other media may be placed on the vessel through any process, including but not limited to, printing, stamping, engraving. In addition, the indicia, figures, patterns, images or other media may be two dimensional or three dimensional on any portion or on all of the vessel or removable lid.

The vessel and removable lid may be made from or contain any material, and need not be made from the same material. A preferred material is plastic, but other materials that may be used include but are not limited to, rubbers, thermoplastics, elastomers, fabrics, glass products such as but not limited to fiberglass, animal products such as but not limited to leather, plant products such as but not limited to bamboo, foams, metals such as but not limited to aluminum, wood or wood products, paper or paper products, waxes, or any combination of these or other materials.

Figure 2:
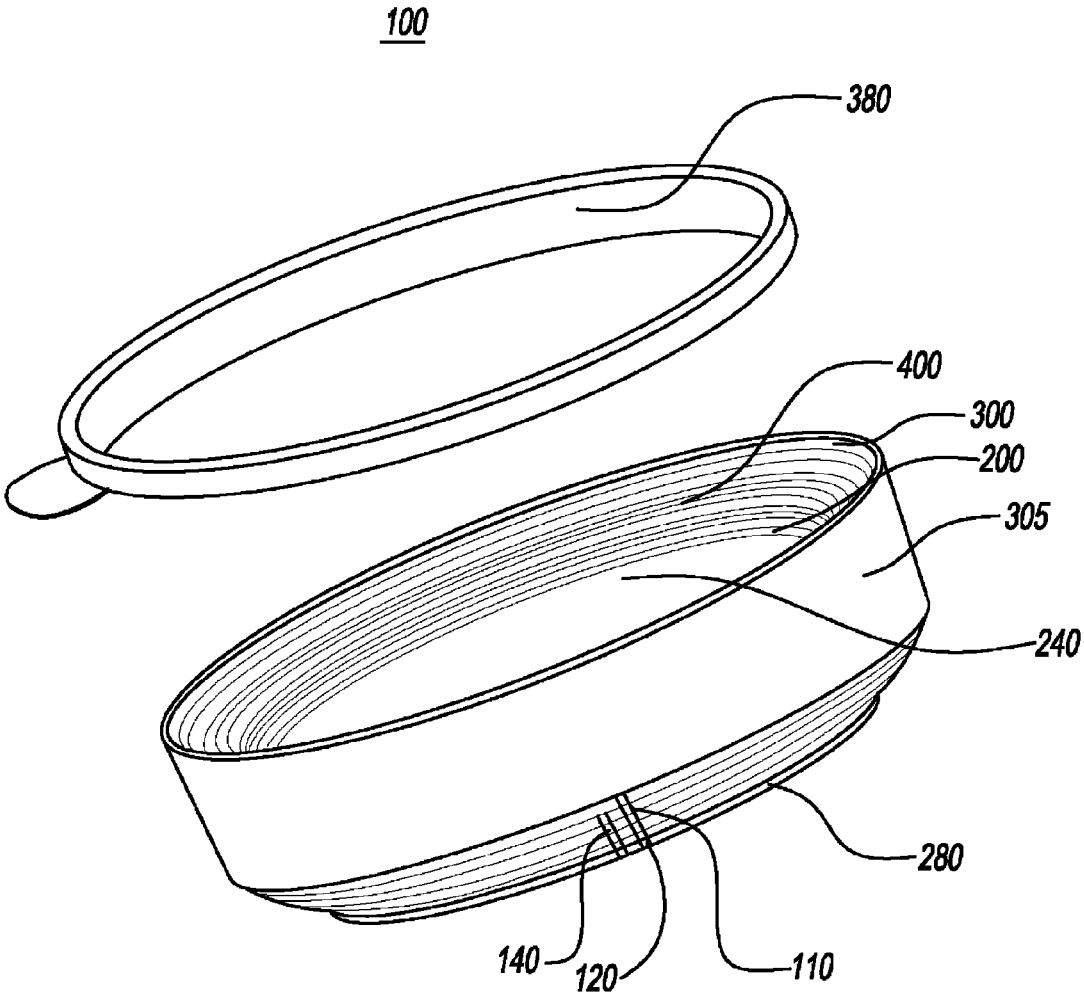

FIG. 2 is a perspective view of the invention in a collapsed configuration. Shown in FIG. 2 is a vessel 100 with a groove 110, a pin block 120, and a locking dent 140. These features allow the cup to be collapsed and expanded.

FIG. 2 also shows a bottom ring 200, a bottom ring bottom wall inside bottom surface 240, a bottom disposed on bottom wall 280, a top ring 300, with a top lip 305, a removable lid 380, and a middle ring 400.

Figure 3A:
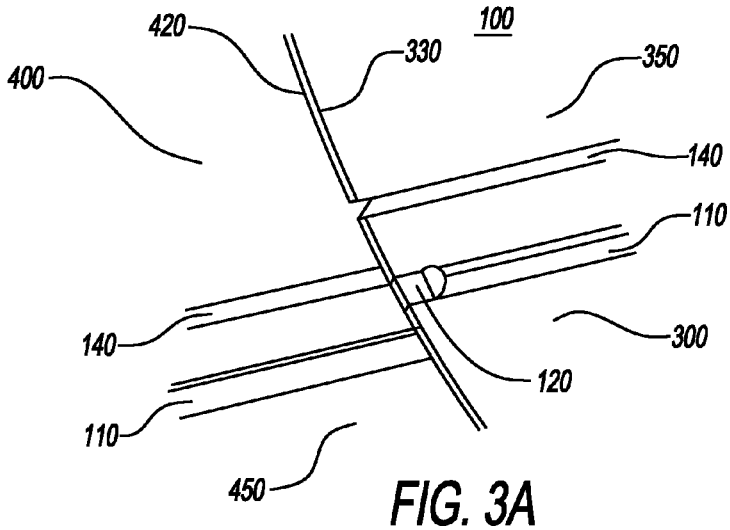
Figure 3B:
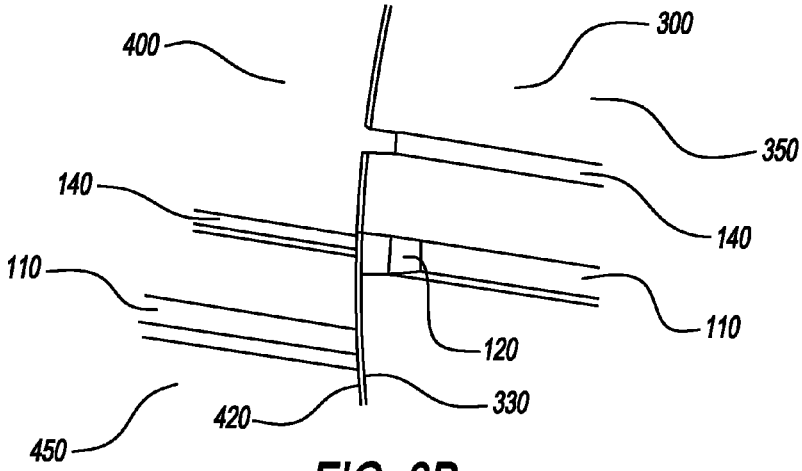
Figure 3C:
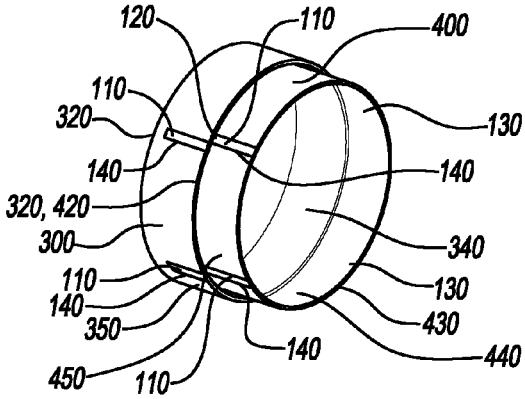

FIG. 3 is an exploded view of an invention component; there are three views in FIG. 3: FIG. 3*a*, FIG. 3*b*, and FIG. 3*c*. They show a detailed view of the mechanism that allows the vessel 100 to expand and collapse.

FIG. 3*a* shows a portion of the vessel 100 with a groove 110, a pin block 120, and a locking dent 140. Also shown in FIG. 3*a* is a top ring 300, top ring top wall lower top edge 330, top ring top wall outside top surface 350; and a middle ring 400, with a middle ring middle wall upper middle edge 420, and a middle ring middle wall outside middle surface 450.

FIG. 3*b* shows a portion of the vessel 100 with a groove 110, a pin block 120, and a locking dent 140. Also shown in FIG. 3*b* is a top ring 300, top ring top wall lower top edge 330, top ring top wall outside top surface 350; and a middle ring 400, with a middle ring middle wall upper middle edge 420, and a middle ring middle wall outside middle surface 450.

FIG. 3*c* shows a portion of the vessel 100, with groove 110, pin block 120, pin 130, and locking dent 140. FIG. 3*c* also shows top ring 300, with top ring top wall upper top edge 320, top ring top wall lower top edge 330, top ring top wall inside top surface 340, top ring top wall outside top surface 350; and middle ring 400, with middle ring middle wall upper middle edge 420, middle ring middle wall lower middle edge 430, middle ring middle wall inside middle surface 440, and middle ring middle wall outside middle surface 450.

The pin 130 may be attached to the vessel 100 in any manner and in any place on the vessel, but it is preferred that the pin 130 be welded to the top wall inside surface.

As can be seen from the three views in FIG. 3, the expand/collapse operation of the vessel 100 is enabled by the pin and groove assembly. When the vessel 100 is collapsed, the pin block 120 is not blocking the pin 130, and the pin block 120 slides through the groove 110 to allow the rings of the vessel to nestle inside each other. When rings of the vessel 100 are pulled upward and twisted to expand the vessel 100, the pin block 120 blocks the pin 130 and the locking dent 140 to keep the vessel from collapsing. FIG. 3*a* shows the vessel 100 partially twisted, so that the pin block 120 is not blocking the pin 130 and locking dent 140. FIG. 3*b* shows the vessel 100 twisted to its full capacity, so that the pin block 120 is now blocking the pin 130 and the locking dent 140. FIG. 3*c* shows the vessel twisted to full capacity, and also shows the pins 130 on the middle ring middle wall inside middle surface 440.

Figure 4:
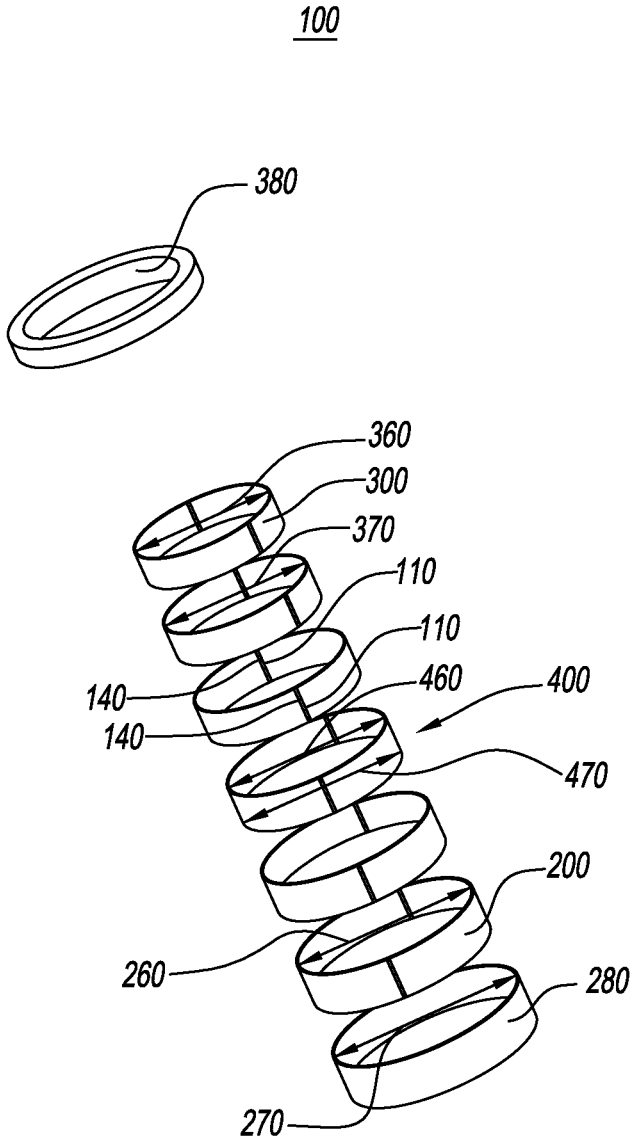

FIG. 4 shows the vessel 100 with groove 110, locking dent 140, bottom ring 200, bottom ring bottom wall upper bottom edge diameter 260, bottom ring bottom wall lower bottom edge diameter 270, bottom disposed on bottom wall 280, top ring 300, top ring top wall upper top edge diameter 360, top ring top wall lower top edge diameter 370, removable lid 380, middle ring 400, middle ring middle wall upper middle diameter 460, and middle ring middle wall lower middle diameter 470.

FIG. 4 illustrates how a vessel 100 with a plurality of rings may be assembled. As can be seen in FIG. 4, if all of the grooves 110 are lined up such that the locking dents 140 and pins (shown in FIG. 3) are blocked by the pin block (shown in FIG. 3), then the vessel 100 is expanded to its full capacity. This figure also illustrates that vessel 100 may be partially expanded if the user doesn't wish to use the full capacity of the vessel.

Figure 5:
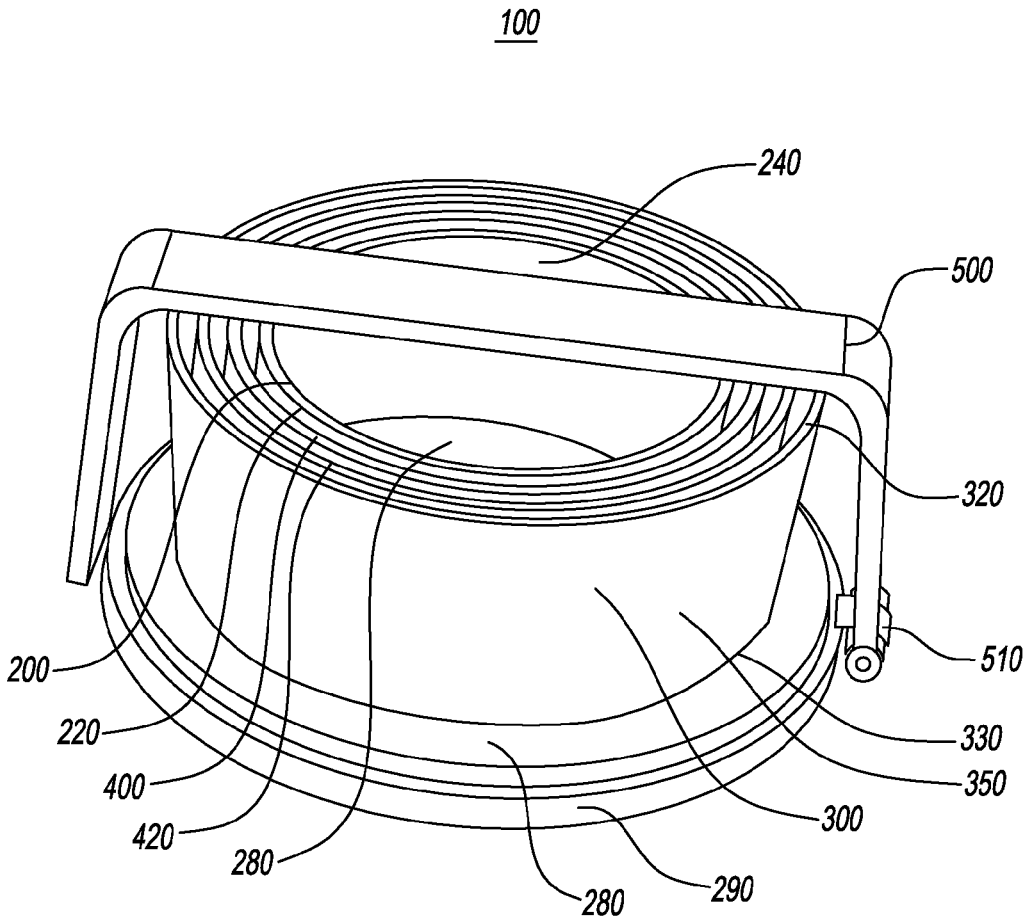
FIGS. 5-6 illustrate the second embodiment.
Figure 6:
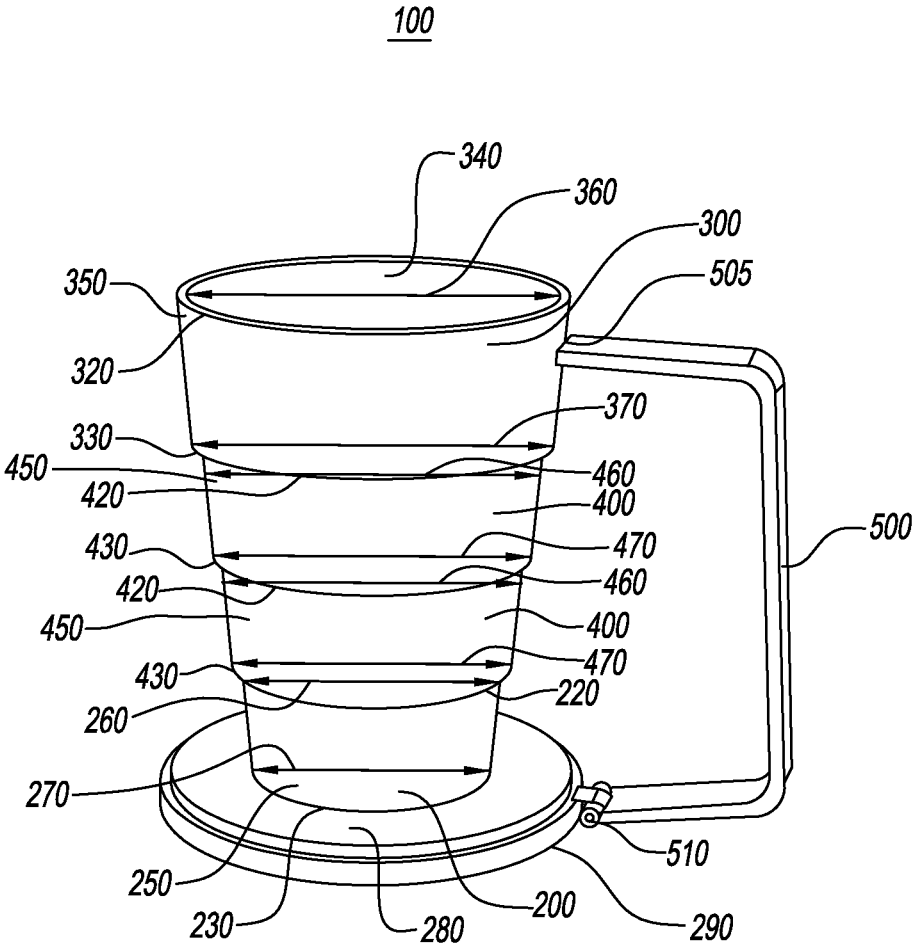

FIGS. 5-6 show an alternative embodiment of the invention. The major differences between this embodiment and the first embodiment are that a handle replaces the pin and groove as a stabilizing feature, and an era bottom is added to this embodiment.

FIG. 5 is a perspective view of the invention in a collapsed configuration. FIG. 5 shows vessel 100 with bottom ring 200, bottom ring bottom wall upper bottom edge 220, bottom ring bottom wall inside bottom surface 240, bottom disposed on bottom wall 280, era bottom 290, top ring 300, top ring top wall upper top edge 320, top ring top wall lower top edge 330, top ring top wall outside top surface 350, middle ring 400, middle ring middle wall upper middle edge 420, handle 500, and hinge 510.

FIG. 6 is side view of the invention in an extended configuration. FIG. 6 shows the vessel 100 with bottom ring 200, bottom ring bottom wall upper bottom edge 220, bottom ring bottom wall lower bottom edge 230, bottom ring bottom wall outside bottom surface 250, bottom ring bottom wall upper bottom edge diameter 260, bottom ring bottom wall lower bottom edge diameter 270, bottom disposed on bottom wall 280, and era bottom 290.

Also shown in FIG. 6 is top ring 300, top ring top wall upper top edge 320, top ring top wall lower top edge 330, top ring top wall inside top surface 340, top ring top wall outside top surface 350, top ring top wall upper top edge diameter 360, and top ring top wall lower top edge diameter 370.

FIG. 6 also shows middle ring 400, middle ring middle wall upper middle edge 420, middle ring middle wall lower middle edge 430, middle ring middle wall outside middle surface 450, middle ring middle wall upper middle diameter 460, and middle ring middle wall lower middle diameter 470.

Also illustrated in FIG. 6 is handle 500, vessel/handle interface 505, and hinge 510.

FIGS. 5 and 6 show that the vessel 100 may be collapsed due to the increasing diameters of the rings, which allows them to nestle inside each other. In FIG. 5, the vessel 100 is collapsed, and the handle 500 rests across the nestled rings. To extend the vessel 100, the handle 500 is rotated upward using the hinge 510, and the rings are pulled upward. After the vessel 100 is expanded, the handle 500 is aligned such that it interfaces with the top ring top wall outside top surface 350, using the vessel/handle interface 505. The reverse procedure is used to collapse the vessel 100.

The handle 500 may be adjustable to any height so that it may be interfaced with any spot or spots on the vessel 100, and any ring may contain the vessel/handle interface 505. The vessel/handle interface 505 may be any interface that adds stability to the vessel 100 in the expanded configuration, including but not limited to, an indentation, a slot, a magnetic interface, in which the magnet could be in the handle or the vessel or in both, a pressure interface, or any other interface desired.

The material components and dimensions are the same for this embodiment as described above for the first embodiment.

Figure 7:
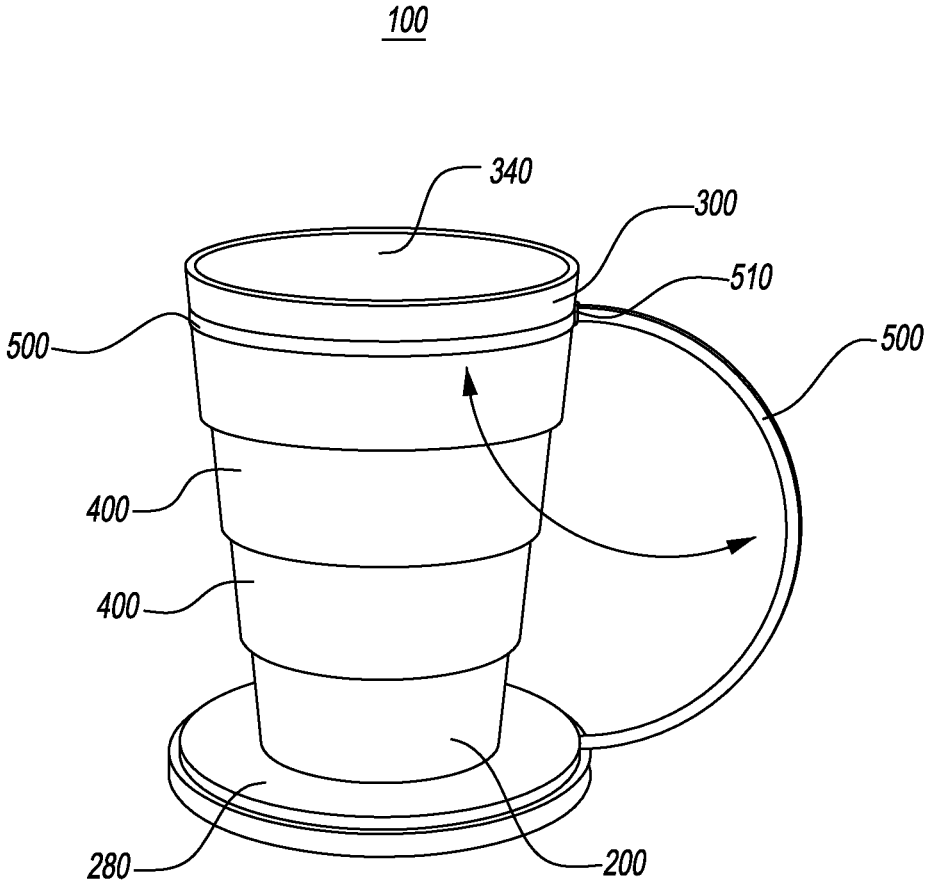
FIGS. 7 illustrates the third embodiment, and is a side view of the invention in an extended configuration.

FIGS. 7 illustrates a third embodiment of the invention, which is different from the previous embodiments because of the handle 500. FIG. 7 is side view of the invention in an extended configuration. FIG. 7 shows the vessel 100 with bottom ring 200, bottom disposed on bottom wall 280, top ring 300, top ring top wall inside top surface 340, and middle ring 400. Also illustrated in FIG. 7 is handle 500, vessel/handle interface 505, and hinge 510.

FIG. 7 shows a handle 500 that is used to stabilize the vessel 100 in the extended configuration, much as the second embodiment discussed above. This embodiment differs from the previous embodiment in that the handle 500 has the hinge 510 at the top instead of at the bottom, and the vessel/handle interface 505 at the bottom of the vessel 100, although it could be anywhere on the vessel as discussed above. In this embodiment, the handle 500 is curved so that it can wrap around the ring 300 of the vessel 100 in the collapsed configuration.

FIGS. 8-13 illustrate the fourth embodiment. This embodiment is different from the other embodiments in the manner in which the extended configuration is stabilized and maintained. As in all the other embodiments discussed previously, the diameters of the rings are such that they may nestle inside each other when the vessel is collapsed, with the top ring having the largest diameter, and the upper edge diameter of any specific ring being greater than its lower edge diameter.

Figure 8:
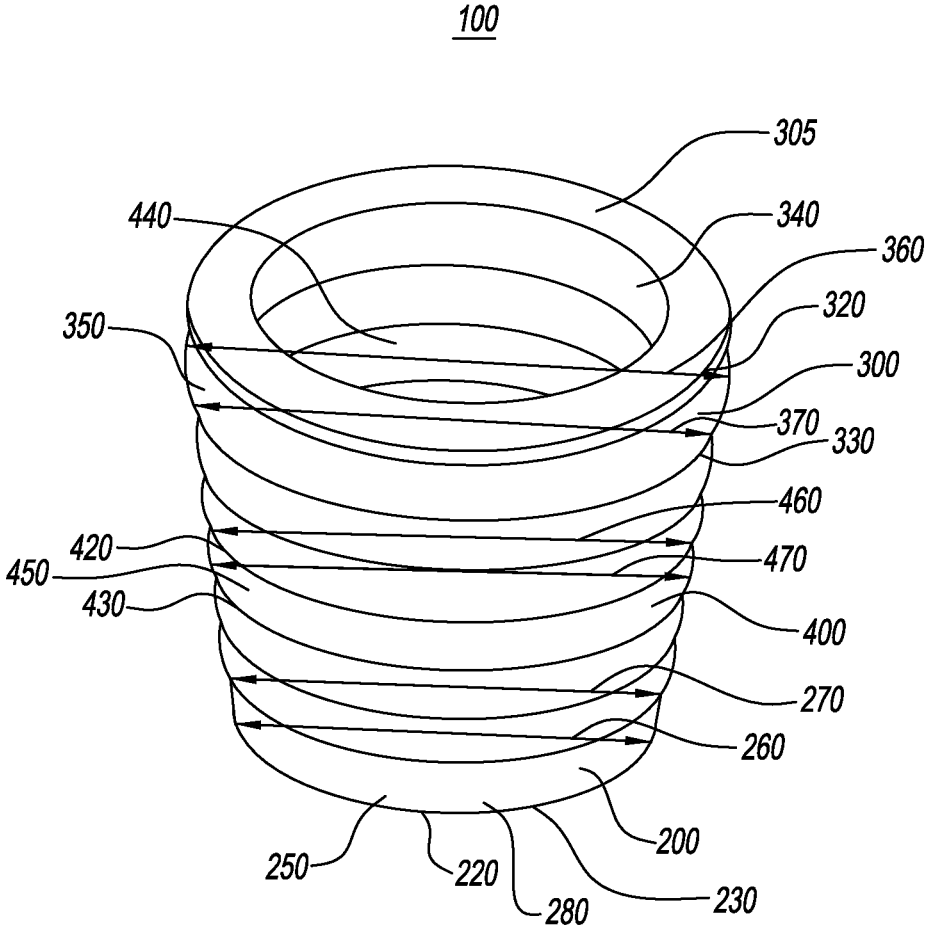
FIGS. 8-13 illustrate the fourth embodiment.

FIG. 8 is a front perspective view of the invention in an extended configuration. Shown is vessel 100 with bottom ring 200, bottom ring bottom wall upper bottom edge 220, bottom ring bottom wall lower bottom edge 230, bottom ring bottom wall outside bottom surface 250, bottom ring bottom wall upper bottom edge diameter 260, bottom ring bottom wall lower bottom edge diameter 270, and bottom disposed on bottom wall 280.

Also shown is top ring 300, with top lip 305, top ring top wall upper top edge 320, top ring top wall lower top edge 330, top ring top wall inside top surface 340, top ring top wall outside top surface 350, top ring top wall upper top edge diameter 360, and top ring top wall lower top edge diameter 370.

FIG. 8 also shows middle ring 400, middle ring middle wall upper middle edge 420, middle ring middle wall lower middle edge 430, middle ring middle wall inside middle surface 440, middle ring middle wall outside middle surface 450, middle ring middle wall upper middle diameter 460, and middle ring middle wall lower middle diameter 470.

FIG. 8 shows the outside of the vessel only. The stabilizing mechanism is inside the walls of the vessel, and will be discussed when shown in a cut-away view.

Figure 9:
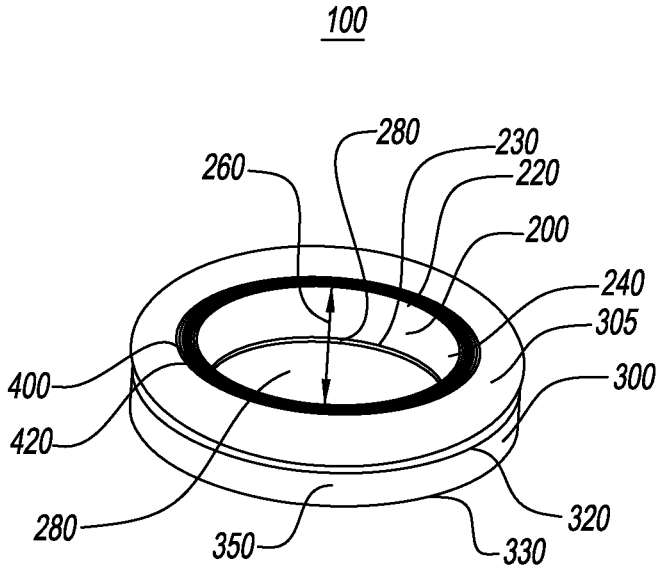

FIG. 9 is a front perspective view of the invention in a collapsed configuration. FIG. 9 shows vessel 100, with bottom ring 200, bottom ring bottom wall upper bottom edge 220, bottom ring bottom wall lower bottom edge 230, bottom ring bottom wall inside bottom surface 240, bottom ring bottom wall upper bottom edge diameter 260, and bottom disposed on bottom wall 280. Also shown are top ring 300, top lip 305, top ring top wall upper top edge 320, top ring top wall lower top edge 330, top ring top wall outside top surface 350, middle ring 400, and middle ring middle wall upper middle edge 420.

Figure 10:
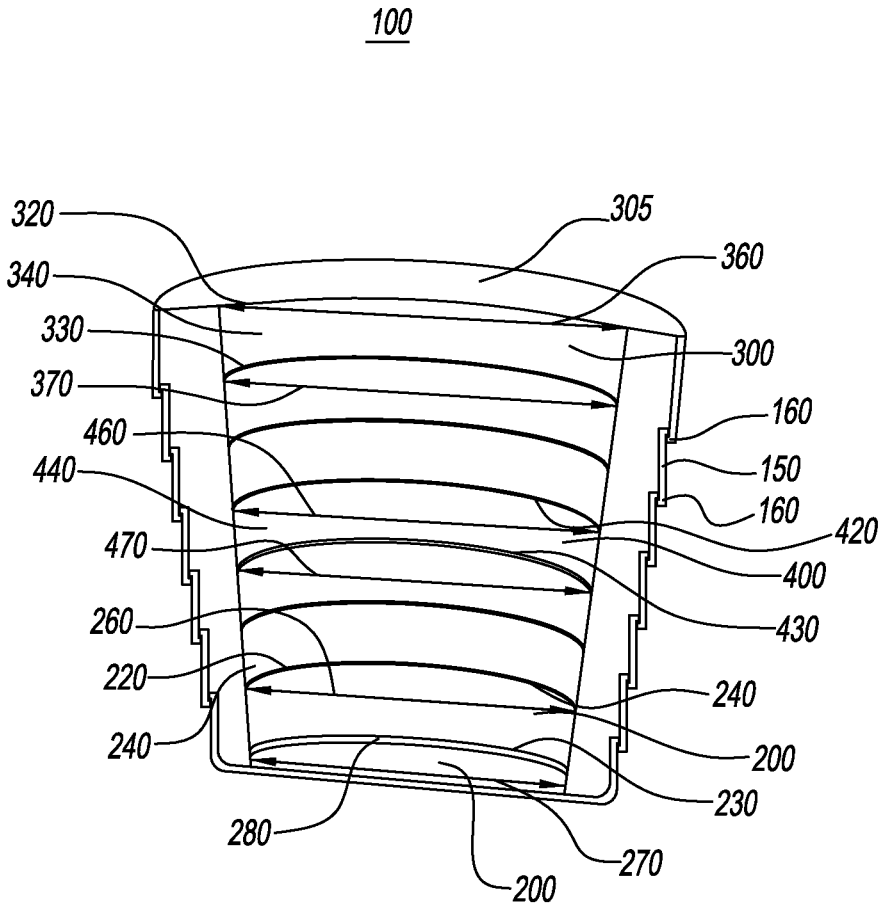

FIG. 10 is a side cut-away view of the invention in an extended configuration. Shown in FIG. 10 is vessel 100 sliding groove 150, interlocking pin block 160, bottom ring 200, bottom ring bottom wall upper bottom edge 220, bottom ring bottom wall lower bottom edge 230, bottom ring bottom wall inside bottom surface 240, bottom ring bottom wall upper bottom edge diameter 260, bottom ring bottom wall lower bottom edge diameter 270, and bottom disposed on bottom wall 280.

FIG. 10 also shows top ring 300, top lip 305, top ring top wall upper top edge 320, top ring top wall lower top edge 330, top ring top wall inside top surface 340, top ring top wall upper top edge diameter 360, and top ring top wall lower top edge diameter 370.

Also shown is middle ring 400, middle ring middle wall upper middle edge 420, middle ring middle wall lower middle edge 430, middle ring middle wall inside middle surface 440, middle ring middle wall upper middle diameter 460, and middle ring middle wall lower middle diameter 470.

Figure 11:
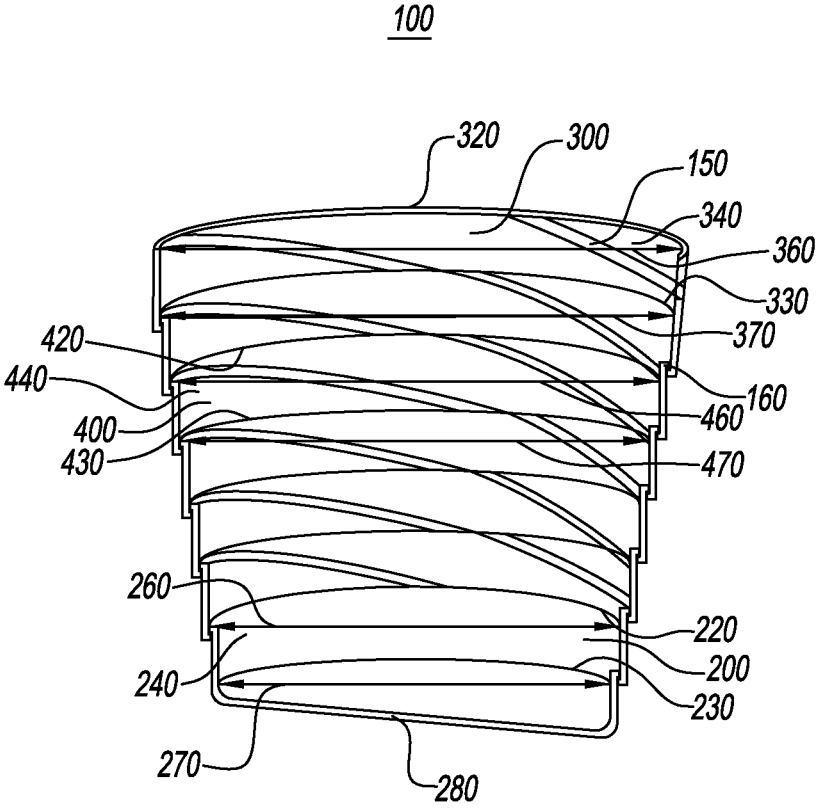

FIG. 11 is an inside cut-away view of the invention in an extended configuration. FIG. 11 shows vessel 100 with sliding groove 150, interlocking pin block 160, bottom ring 200, bottom ring bottom wall upper bottom edge 220, bottom ring bottom wall lower bottom edge 230, bottom ring bottom wall inside bottom surface 240, bottom ring bottom wall upper bottom edge diameter 260, bottom ring bottom wall lower bottom edge diameter 270, bottom disposed on bottom wall 280, FIG. 11 also shows top ring 300, top lip 305, top ring top wall upper top edge 320, top ring top wall lower top edge 330, top ring top wall inside top surface 340, top ring top wall upper top edge diameter 360, top ring top wall lower top edge diameter 370.

Also shown in FIG. 11 is middle ring 400, middle ring middle wall 410, middle ring middle wall upper middle edge 420, middle ring middle wall lower middle edge 430, middle ring middle wall inside middle surface 440, middle ring middle wall upper middle diameter 460, middle ring middle wall lower middle diameter 470.

FIGS. 10 and 11 illustrate the stabilizing mechanism of the vessel, which is a sliding groove 150 and interlocking pin block 160. In order to expand the vessel 100 from the collapsed configuration, the vessel 100 is twisted while pulling up, thus enabling the interlocking pin block 160 to slide in the sliding groove 150 until it reaches pin 130, which holds the expanded configuration stable. To collapse the vessel, the vessel is twisted in the opposite direction while pushing down.

Figure 12:
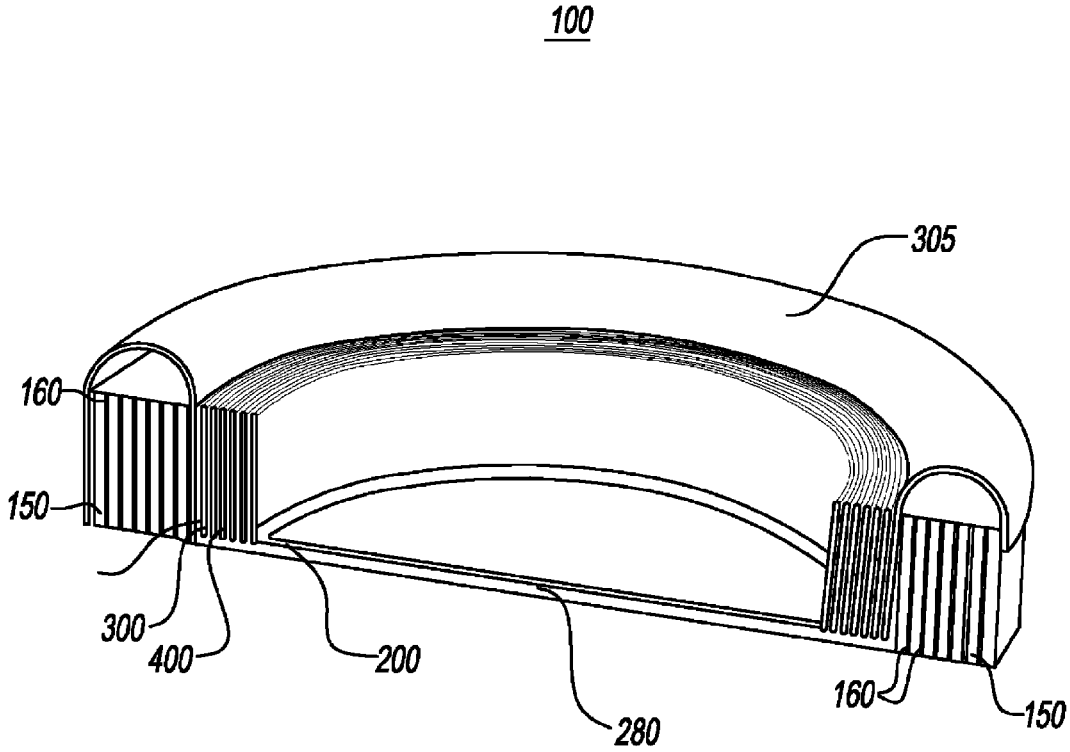

FIG. 12 is an inside cut-away view of the invention in a collapsed configuration. FIG. 12 shows vessel 100 with sliding groove 150, interlocking pin block 160, bottom ring 200, bottom disposed on bottom wall 280, top ring 300, top lip 305, and middle ring 400. This figure illustrates that the stabilizing mechanism resides in the wall of the vessel 100, thus reducing possibility of damage to the mechanism.

Figure 13:
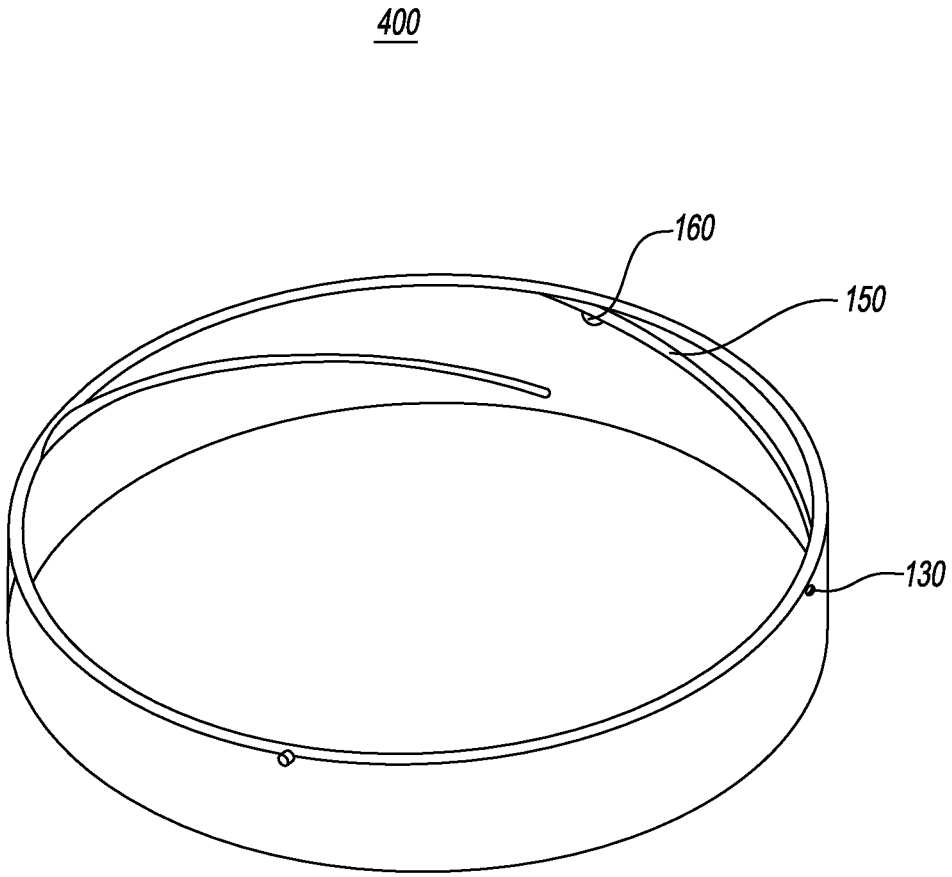

FIG. 13 is an exploded view of the stabilizing component of the invention. FIG. 13 shows a middle ring 400 with sliding groove 150 and interlocking pin block 160, and pin 130. As described above, the interlocking pin block 160 slides along the sliding groove 150 as the vessel 100 is twisted and pulled up, until the interlocking pin block 160 encounters the pin 130, at which point the vessel 100 is fully expanded and stabilized.

FIGS. 14-18 illustrate the fifth embodiment of the invention. In this embodiment, the middle ring(s) is the smallest in diameter, the top ring is smaller in diameter than the bottom ring, and the middle and top rings nestle in the bottom ring. This differs from the previous embodiments, in that in the other embodiments all of the rings nestled in the top ring.

Figure 14:
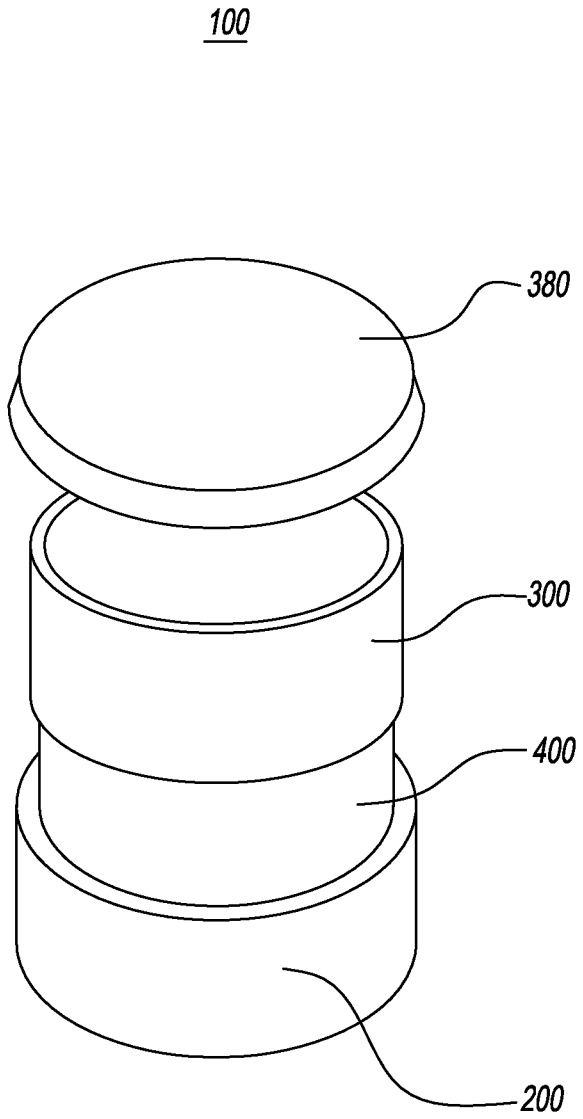
FIGS. 14-18 illustrate the fifth embodiment.

FIG. 14 is a front perspective view of the invention in an extended configuration. FIG. 14 shows the vessel 100 with bottom ring 200, top ring 300, middle ring 400, and removable lid 380.

Figure 15:
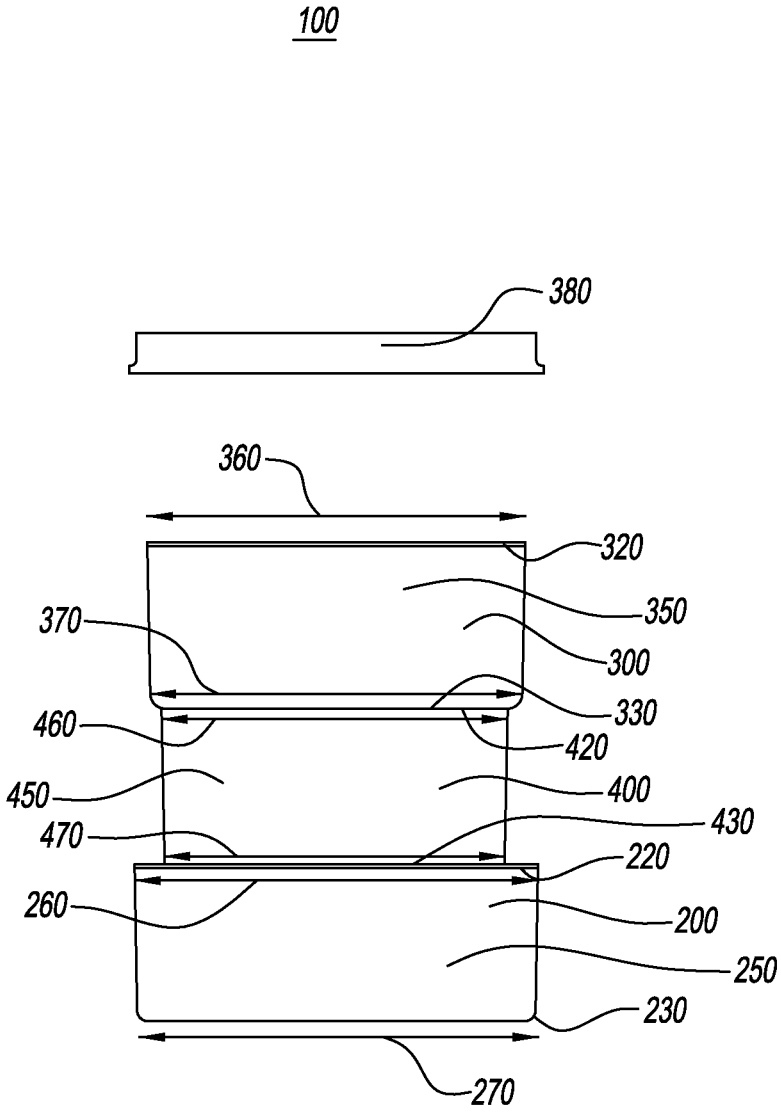

FIG. 15 is a front view of the invention in an extended configuration. FIG. 15 shows vessel 100 with bottom ring 200, bottom ring bottom wall upper bottom edge 220, bottom ring bottom wall lower bottom edge 230, bottom ring bottom wall outside bottom surface 250, bottom ring bottom wall upper bottom edge diameter 260, bottom ring and bottom wall lower bottom edge diameter 270.

Also shown in FIG. 15 is top ring 300, top ring top wall upper top edge 320, top ring top wall lower top edge 330, top ring top wall outside top surface 350, top ring top wall upper top edge diameter 360, top ring top wall lower top edge diameter 370, and removable lid 380.

FIG. 15 shows middle ring 400, middle ring middle wall upper middle edge 420, middle ring middle wall lower middle edge 430, middle ring middle wall outside middle surface 450, middle ring middle wall upper middle diameter 460, middle ring middle wall lower middle diameter 470.

As discussed above, one difference between this embodiment and the other embodiments is the relative ring diameters. Not only are the diameters equal in each of the rings, they are such that bottom ring 200 is the largest. The largest diameter is the bottom ring bottom wall lower bottom edge diameter 270, which in this embodiment is equal to the bottom ring bottom wall upper bottom edge diameter 260. The next largest diameter is the top ring top wall lower top edge diameter 370, which is equal to the top ring top wall upper top edge diameter 360. The smallest diameter is for the middle ring 400, in which the middle ring middle wall upper middle diameter 460 and middle ring middle wall lower middle diameter 470 are equal.

Figure 16:
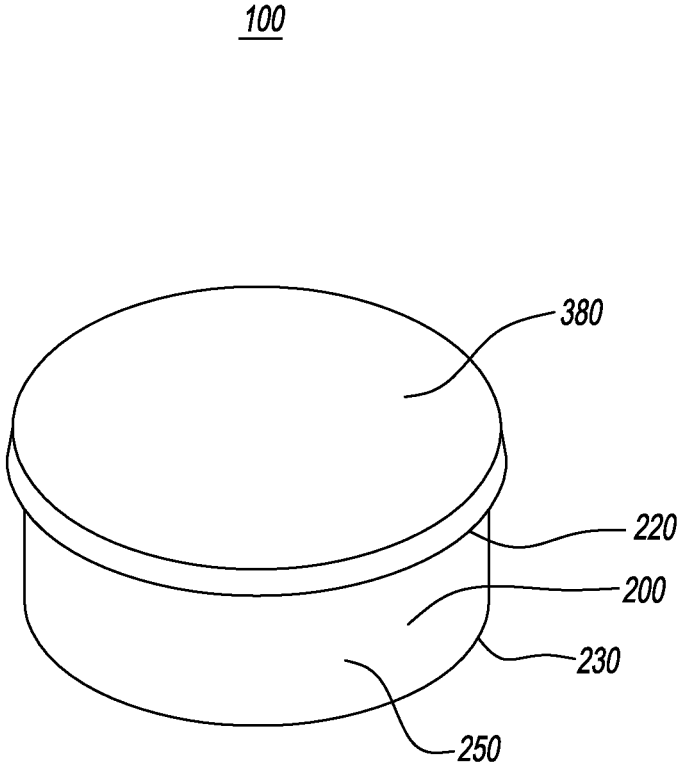

FIG. 16 is a front perspective view of the invention in a collapsed configuration with a lid. FIG. 16 shows vessel 100 with bottom ring 200, bottom ring bottom wall upper top edge 220, bottom ring bottom wall lower top edge 230, bottom ring bottom wall outside top surface 250, and removable lid 380.

Figure 17:
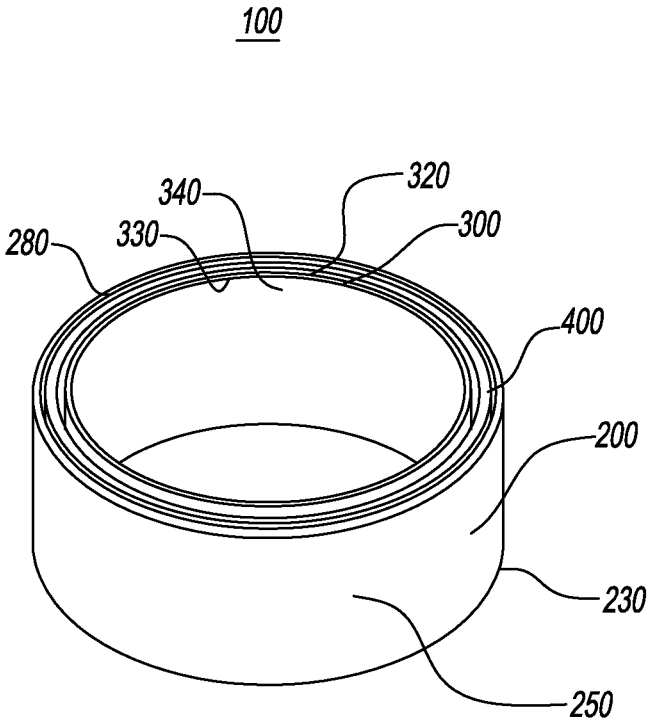

FIG. 17 is a front perspective view of the invention in a collapsed configuration with the lid removed. FIG. 17 shows vessel 100 with bottom ring 200, bottom ring bottom wall lower bottom edge 230, bottom ring bottom wall outside bottom surface 250, and bottom 280. This figure illustrates that the middle ring 400 and top ring 300 nestle in the bottom ring 200.

Also shown in FIG. 17 is top ring 300, top ring top wall upper top edge 320, top ring top wall lower top edge 330, top ring top wall inside top surface 340, and middle ring 400 with middle ring middle wall upper middle edge 420.

Figure 18:
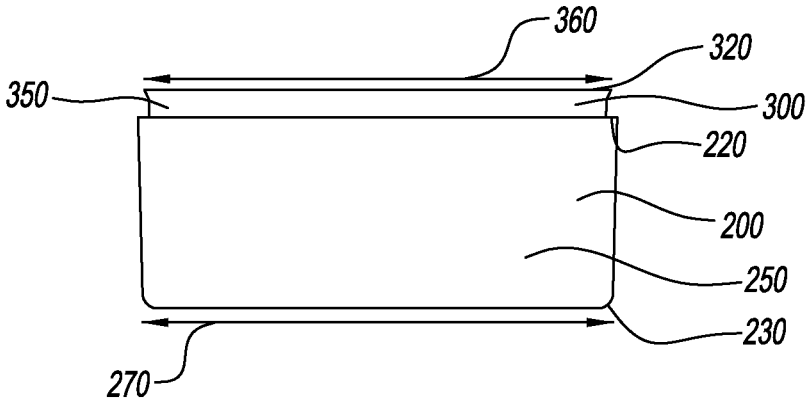

FIG. 18 is a front perspective view of the invention in a collapsed configuration with the lid removed. FIG. 18 illustrates the relative diameters of the top ring 300 and bottom rings 400, and shows how the rings nestle. FIG. 18 shows vessel 100 with bottom ring 200, bottom ring bottom wall upper bottom edge 220, bottom ring bottom wall lower bottom edge 230, bottom ring bottom wall outside bottom surface 250, top ring 300, top ring top wall upper top edge 320, and top ring top wall outside top surface 350. Also shown are the bottom ring bottom wall lower bottom edge diameter 270, and the top ring top wall upper top edge diameter 360.

This embodiment is extended by pulling straight up on the vessel 100. The rigidity of the construction materials are such that the vessel stays extended until it is pushed down into the collapsed configuration.

Another embodiment of the invention comprises a cap that seals the cup when collapsed and not in use. Cap may be removed and used as housing of snack type food while user drinks from the cup.

Yet another embodiment of the invention comprises a cup that may be squeezed to collapse. According to this embodiment one axis of the cup resists flexing while the other one is more easily flexed.

According to still another embodiment the cup can be collapsed in relation to its vertical axis. According to this embodiment one half of the cup is flexible rubber and the other half is rigid piece so as to enable grasping the cup.

An even further embodiment provides a cup that opens like a Chinese paper lantern.

According to another embodiment the cup opens to a cone. According to this embodiment the cup may be made of waterproof fabric.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed:

1. A vessel comprising:

a bottom cylindrical ring having an inwardly protruding groove running from the top of said bottom ring to a termination in a vicinity of the bottom of said bottom ring, said termination creating a locking pin; and an inwardly protruding locking dent running from the top of said bottom ring to the bottom of said bottom ring, and wherein said locking dent is substantially parallel to said groove;

a middle ring, wherein the middle ring has a middle wall, the middle wall having upper and lower middle edges, inside and outside middle surfaces, upper and lower middle diameters, a groove extending from the upper middle edge to the lower middle edge, the groove having a pin block, an inwardly protruding locking dent running from the upper middle edge to the lower middle edge, and at least one pin located on the middle inside surface proximate to the middle bottom edge, wherein the middle ring is sized to be a nestable and twistable fit to the outer surface of the bottom ring and wherein the middle ring locking dent is being shaped, sized and located to be matching fit to said bottom ring locking dent such that when the grooves of the middle ring and the bottom ring are engaged, said locking dents are also engaged; and a top cylindrical ring sized to be a nestable and a twistable fit to the outer surface of said middle ring, wherein said top ring comprises:

an inwardly protruding groove running from the top of said top ring to a termination in a vicinity of the bottom of said top ring, said termination creating a locking pin, said top ring groove being shaped and sized to be a matching fit to said bottom ring groove; and an inwardly protruding locking dent running from the top of said top ring to the bottom of said top ring, and wherein said locking dent is substantially parallel to said groove, and said top ring locking dent being shaped, sized and located to be a matching fit to said middle ring locking dent such that when said grooves are engaged, said locking dents are also engaged; and wherein said top, middle and bottom rings are shaped and sized such that in a compact configuration, said rings nest inside each other with said grooves and locking dents nested inside each other, and in an extended configuration said top ring extends up beyond said middle ring and bottom ring, and said middle ring extends up beyond said bottom ring, and said top ring groove is aligned by twisting to engage with said middle ring locking dent, and said middle ring groove is aligned by twisting to engage said bottom ring locking dent, thereby resisting vertical forces.

2. The vessel of claim 1, wherein the vessel has a plurality of middle rings, sized to be nestable and twistable fit to each other, and wherein uppermost of the middle rings locks with the top ring and lowermost of the middle rings locks with the bottom ring.

3. The vessel of claim 2, wherein the bottom ring upper diameter is greater than the bottom ring lower diameter, the top ring upper diameter is greater than the top ring lower diameter and each middle ring upper middle diameter is greater than the middle ring lower middle diameter.

4. The vessel of claim 2, wherein the top ring can be extended over the bottom ring, and each ring has a portion of an image or logo on the outside or inside surface that is completed with the top ring is extended.

5. A vessel, comprising:

a bottom cylindrical ring;

a top cylindrical ring sized to be a nestable and a twistable fit to the outer surface of said bottom ring; and wherein said bottom ring comprises:

an inwardly protruding groove running from the top of said bottom ring to a termination in a vicinity of the bottom of said bottom ring, said termination creating a locking pin; and an inwardly protruding locking dent running from the top of said bottom ring to the bottom of said bottom ring, and wherein said locking dent is substantially parallel to said groove; and wherein said top ring comprises:

an inwardly protruding groove running from the top of said top ring to a termination in a vicinity of the bottom of said top ring, said termination creating a locking pin, said top ring groove being shaped and sized to be a matching fit to said bottom ring groove; and an inwardly protruding locking dent running from the top of said top ring to the bottom of said top ring, and wherein said locking dent is substantially parallel to said groove, and said top ring locking dent being shaped, sized and located to be a matching fit to said bottom ring locking dent such that when said grooves are engaged, said locking rings are also engaged; and wherein said top and bottom rings are shaped and sized such that in a compact configuration, said rings nest inside each other with said grooves and locking dents nested inside each other, and in an extended configuration said top ring extends up beyond said bottom ring, and said top ring groove is aligned by twisting to engage with said bottom ring locking dent, thereby resisting vertical forces.

6. The vessel of claim 5, wherein the vessel further comprises a removable lid.

7. The vessel of claim 5, wherein the locking dent is a separate groove.

8. The vessel of claim 5, wherein the vessel is made of plastic.

9. The vessel of claim 5, wherein the bottom ring upper diameter is greater than the bottom ring lower diameter and the top ring upper diameter is greater than the top ring lower diameter.

10. The vessel of claim 5, wherein the vessel is a cup.

11. The vessel of claim 5, wherein there is a volume indication on the inside surface.

12. The vessel of claim 5, wherein there is a volume indication on the outside surface.

* * * * *